United States Patent [19]

Smith et al.

[11] 4,114,200

[45] Sep. 19, 1978

[54] LIQUID IMPERVIOUS CUFF FOR A DISPOSABLE SURGICAL GOWN AND METHOD OF ATTACHMENT OF THE CUFF THERETO

[75] Inventors: Linda Hebert Smith, Knoxville; Robert C. Johnson, Memphis, both of Tenn.

[73] Assignee: The Buckeye Cellulose Corporation, Cincinnati, Ohio

[21] Appl. No.: 759,631

[22] Filed: Jan. 17, 1977

[51] Int. Cl.[2] ..... A41D 13/00; A41B 7/12

[52] U.S. Cl. ..... 2/51; 2/123

[58] Field of Search ..... 2/51, 59, 60, 83, 114, 2/123, 243 R, 243 A, 270, DIG. 5, DIG. 7, 131; 112/262, 400, 416; 128/132 R, 132 D

[56] References Cited

U.S. PATENT DOCUMENTS

| | | | |
|---|---|---|---|
| 1,933,717 | 3/1935 | Hemmerich | 2/123 |
| 2,124,721 | 7/1938 | Wagner | 2/243 R |
| 2,299,982 | 10/1942 | Harrison | 2/123 X |
| 2,500,911 | 3/1950 | Cohn | 2/131 |
| 2,633,576 | 4/1953 | Powers et al. | 2/60 |
| 2,641,765 | 6/1953 | Stein | 2/123 |
| 2,983,027 | 5/1961 | Rogers | 2/270 X |
| 3,088,117 | 5/1963 | Baker | 2/123 X |
| 3,333,280 | 8/1967 | Hynek et al. | 112/262 X |
| 3,803,640 | 4/1974 | Ericson | 2/114 |
| 3,868,728 | 3/1975 | Krzewinski | 2/114 |

FOREIGN PATENT DOCUMENTS

| | | | |
|---|---|---|---|
| 649,533 | 8/1937 | Fed. Rep. of Germany | 2/243 |

*Primary Examiner*—Werner H. Schroeder
*Assistant Examiner*—Moshe I. Cohen
*Attorney, Agent, or Firm*—Melville, Strasser, Foster & Hoffman

[57] ABSTRACT

A liquid impervious cuff assembly for a disposable surgical gown or the like comprising a stockinette folded back upon itself to form a double-walled, substantially cylindrical cuff envelope folded at its forward end, open at its rearward end and having inner and outer walls. A layer of liquid impervious material is located between the inner and outer walls of the cuff envelope. The open end of the cuff envelope and the fluid impervious layer between the wall thereof are attached to the free end of a surgical gown sleeve. This attachement may be accomplished by sewing the inner wall, the liquid impervious layer and the outer wall at the open end of the cuff envelope to the free end of the surgical sleeve. The cuff assembly may be adhesively attached to the free end of the gown sleeve. For example, the inner wall, liquid impervious layer and outer wall of the cuff envelope at the open end thereof may be arranged in an overlapping orientation and each adhered directly to the free end of the surgical gown sleeve by adhesive means.

35 Claims, 7 Drawing Figures

LIQUID IMPERVIOUS CUFF FOR A DISPOSABLE SURGICAL GOWN AND METHOD OF ATTACHMENT OF THE CUFF THERETO

BACKGROUND OF THE INVENTION

1. Field of the Invention

The invention relates to a cuff assembly for a surgical gown, protective garment or the like, and more particularly to a liquid impervious cuff assembly.

2. Description of the Prior Art

The liquid impervious cuff assembly of the present invention has many uses. For example, it may be applied to protective industrial clothing, garments protective against the elements and various types of sportswear such as ski jackets and suits.

While its use need not be so limited, the liquid impervious cuff assembly of the present invention finds particular utility in its applicaton to the sleeve of another type of protective garment, a surgical gown which protects the sterile field. The cuff assembly may be applied to conventional, reusable surgical gowns. In recent years, there has been a trend toward the use of single use, disposable surgical gowns of liquid strike-through resistant cloth substitutes such as paper, non-wovens and laminates. The present invention provides a liquid impervious cuff especially suitable for such disposable surgical gowns.

Prior art workers have taken numerous approaches to the forearm and cuff areas of surgical gowns and the like. For example, U.S. Pat. No. 3,639,917 to Victor E. Althouse, dated Feb. 8, 1972, teaches the use of heat recoverable elastomeric materials to form gathers in disposable garments of non-woven fabrics. U.S. Pat. No. 3,657,741, in the Name of Victor M. Blanco and dated Apr. 25, 1972, describes a separate surgical protective sleeve of fluid impervious material and adapted to cover at least the forearm portion of a surgeon's gown. U.S. Pat. No. 3,727,239 in the name of Lenore E. Tompson and dated Apr. 17, 1973 sets forth a stretchable cuff of a cloth substitute for disposable surgeon's gowns and the like. The stretchable cuff comprises a layer of foam laminated to a scrim reinforced applique wherein the frequency of the threads aligned in the direction of stretchability is greater than in the cross direction. The cuff may be sewn or adhesively attached to the garment sleeve.

The most common approach is to provide a disposable surgical gown with a cotton rib-knit stockinette folded back upon itself with its edges sewn to the open end of the sleeve. The stockinette cuff serves as a means to gather the open end of the sleeve and to comfortably grip the surgeon's wrist to maintain the sleeve in proper position.

Proper aseptic technique dictates that after the scrubbing and drying procedures, the surgeon (and other members of the surgical team) is assisted into his sterile surgical gown and sterile surgical gloves which extend over the stockinette cuffs and part way up the gown sleeves. The typical body and sleeve material of a disposable surgical gown is liquid strike-through resistant, but the stockinette cuffs are not.

Liquid penetration through fabrics has been found to be a primary vector for transmission of microorganisms, If during the course of his work in the operating room the surgeon's gloves should slip down to the extent that a portion of a typical prior art liquid pervious stockinette cuff is exposed, such microorganism transfer may take place through the cuff. Under the same conditions, the liquid impervious cuff assemblies of the present invention will prevent the transmission of micro-organisms through the cuff.

The cuff assembly of the present invention therefore represents an improvement in aseptic surgical technique and patient safety, providing better assurance of maintenance of asepsis during surgery.

SUMMARY OF THE INVENTION

The liquid impervious cuff assembly of the present invention is particularly adapted for use with surgical gowns, both reusuable and disposable. The cuff preferably comprises a soft, comfortable, nonbinding, liquid absorbent material such as a knit stockinette of slow wicking cotton or other natural or synthetic fibers, elastomeric nonwovens, and the like, folded back upon itself to form a substantially cylindrical cuff envelope with an inner wall and an outer wall. The fold occurs at the forward end of the cuff envelope, the rearward end of the cuff envelope being opened.

A film of flexible fluid impervious material is located between the inner and outer walls of the cuff envelope. The liquid impervious layer may be made of any appropriate flexible and/or elastomeric materiar of sufficient strength to maintain its integrity and capable of being subjected to suitable conventional sterilizing techniques. While it is preferred that the layer be impervious to liquid, the term "liquid impervious" as used herein and in the claims should be interpreted broadly enough to include liquid repellent or strike-through resistant layers. For example, the layer could be made of the same material as the disposable surgical gown, itself.

In one embodiment of the present invention, the open end of the cuff envelope (with the liquid impervious layer between the inner and outer walls thereof) is simultaneously closed and attached to the open end of the surgical gown sleeve, as by sewing. In this way the inner and outer walls of the envelope and the liquid impervious layer are attached to the surgical gown sleeve.

In another embodiment of the present invention the cuff assembly may be adhesively bonded to the surgical gown sleeve in any appropriate manner. Preferably, the inner wall, the liquid impervious layer and the outer wall of the cuff envelope, at the open end thereof, are arranged in an overlapping or "shingled" orientation. The inner and outer walls of the cuff assembly and the liquid impervious layer therebetween are each directly adhered to the open end of the surgical gown sleeve by adhesive means. This latter embodiment and its method of attachment eliminate sewing holes and render the cuff assembly-to-sleeve attachment more readily mechanisable. This latter method of attachment may also be advantageously used to apply a conventional cuff assembly (without a liquid impervious layer) to the sleeve opening of a surgical gown or the like.

The liquid impervious cuff assemblies of the present invention will maintain the comfort and appearance of conventional cuff currently in use.

DESCRIPTION OF THE PREFERRED EMBODIMENTS

Figure 1:
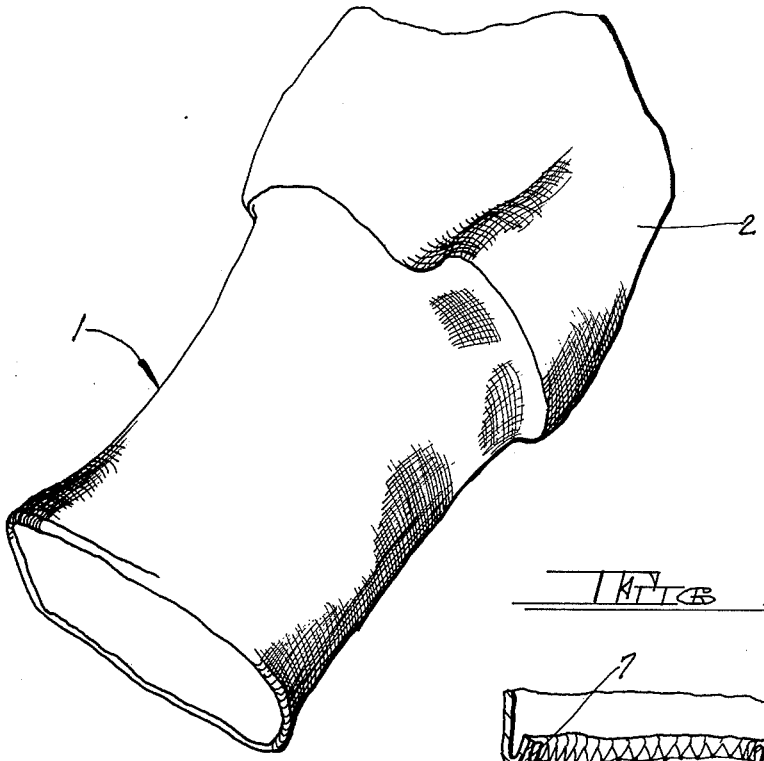
FIG. 1 is a fragmentary perspective view of a surgical gown sleeve provided with the cuff assembly of the present invention, the cuff assembly being attached to the gown sleeve opening by sewing.
Figure 3:
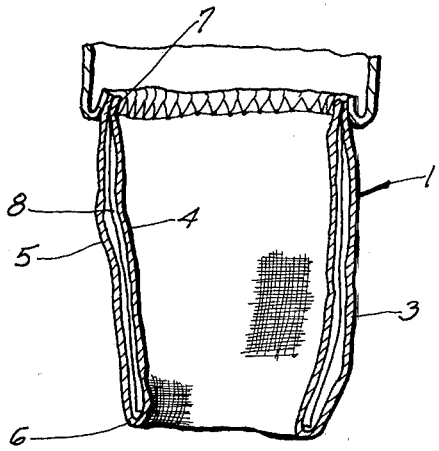
FIG. 3 is a fragmentary cross sectional elevational view of the cuff assembly and sleeve of FIG. 1.
Figure 2:
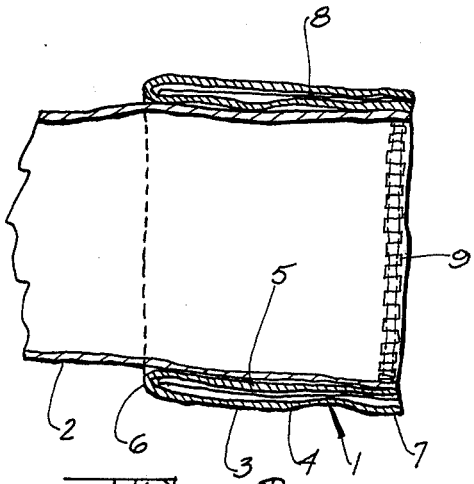
FIG. 2 is a fragmentary cross sectional elevational view of the cuff assembly of FIG. 1 as it appears during attachment to the sleeve.

A first embodiment of the present invention is illustrated in FIGS. 1 through 3, wherein like parts have been given like index numerals. FIG. 1 illustrates a cuff assembly (generally indicated at 1) affixed to the open end of a sleeve 2 of a surgical gown. The sleeve 2 may, for purposes of an exemplary showing, be considered to be the sleeve of a disposable surgical gown made up of a liquid strike-through resistant cloth substitute such as paper, a nonwoven, a laminate, or the like. As is most clearly shown in FIG. 2, the cuff may be made up of a conventional knit stockinette. The stockinette may be knit of any appropriate material including slow wicking cotton or other natural or synthetic fibers. The stockinette is folded upon itself so as to form a double-walled cuff envelope 3 having an inner wall 4 and an outer wall 5. The fold of the cuff envelope 3 occurs at its forwardmost end 6 and the envelope is open at its rearward end 7.

It will be understood by one skilled in the art that the cuff envelope 3 will normally have a lesser diameter than the open end of the surgical gown sleeve 2. The cuff envelope 3 is readily stretchable and should normally have a diameter such that it will comfortably grasp the arm of the surgeon at or about the wrist portion thereof. The cuff envelope will serve to gather the surgical sleeve 2 near the opening thereof, the surgical sleeve having a somewhat puckered appearance, as is shown in FIG. 1. Moreover, it will be understood that other materials may be utilized for the cuff envelope such as a woven cloth, a nonwoven, a polymeric foam, a laminate, or any similar cloth substitute which is preferably soft, flexible, stretchable, elostomeric, comfortable, non-binding, non-irritating to the surgeon's wrist and also preferably liquid absorbent.

In FIG. 2 the parts are shown in position for assembly. The cuff envelope 3 has been stretched and applied about the open end of the sleeve 2 in reverse position so that the rearward or open end 7 of the cuff envelope and the open end of the sleeve 2 coincide. Within the cuff envelope there is located a layer 8 of liquid impervious material.

Any appropriate liquid impervious sheet or film-like material may be used including cast, blown or extruded polymer or copolymer films such as natural rubber, polyurethane, ethylene vinyl acetate, polyethylene, other synthetic latexes or combinations or copolymers of these. These may be used as unsupported films, supported films, or as coatings on an appropriate substrate.

As indicated above, while not preferred, a liquid repellant or liquid strike-through resistant material may also be used. The liquid impervious material may be manufactured in sheet or tube form. If in sheet form, it will be formed into a tube by lapping its longitudinal edges and joining them together by heat sealing, adhesive, or other appropriate means, depending upon the nature of the liquid impervious material used. The liquid impervious material should be thin, flexible, non-bulky and of sufficient strength to maintain its liquid impervious characteristics during use. Excellent results have been achieved, for example, using a tube made from polyurethane film having a thickness of at least about 1 mil. Polyurethane is particularly advantageous in that it is quiet, affording a minimum of rustling sound within the cuff envelope. Again, excellent results have been achieved using a polyurethane film manufactured by the B.F. Goodrich Chemical Company, a division of B. F. Goodrich Company of Cleveland, Ohio, under the trademark Tuftane and designation TF-310. The liquid impervious tube should be such that it will withstand appropriate conventional sterlization methods.

A tube 8 of liquid impervious material having a high modulus of elasticity should have a diameter substantially equal to the diameter of the open end of sleeve 2. A tube 8 of liquid impervious material with a low modulus of elasticity may have a smaller diameter, so long as it is stretchable to the diameter of the open end of sleeve 2. When the parts are arranged in the position illustrated in FIG. 2 about a mandril or the like (not shown), they may be sewn together using a conventional stitch, for example a #504 stitch forming a seam type SSa-2 (Federal Standard #751A), as shown at 9.

After the sewing operation, the cuff assembly is pulled forwardly over the open end of the surgical gown sleeve 2 to achieve its normal postion as illustrated in FIGS. 1 and 3. It will be noted that the liquid impervious tube 8 is so sized as to be substantially coextensive with the inner wall 4 and outer wall 5 of the cuff envelope to render the cuff envelope liquid impervious throughout substantially all of its length. While this arrangement is preferred, the length of the tube 8 may be varied so long as it performs its function. The upper end of the tube 8, however, should be stitched to the sleeve 2, together with the inner wall 4 and outer wall 5 of the envelope 3. In order to maintain the tube in desired position within the envelope, the tube may be additionally attached to one or both walls of the envelope in one or more places by adhesive or heat bonding, or other appropriate means. The cuff assembly of the present invention will maintain the comfort and appearance of conventional stockinette cuffs currently in use.

Figure 4:
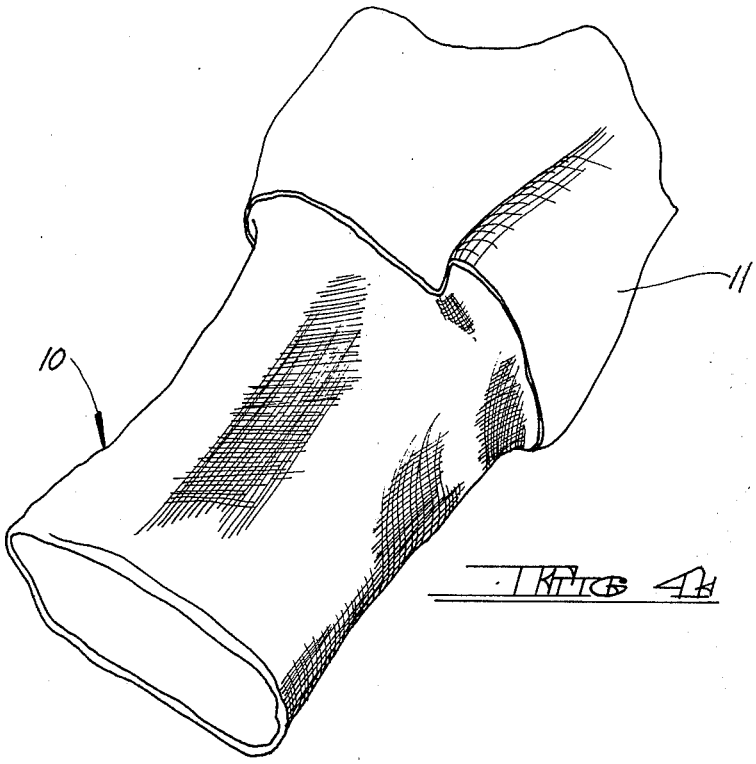
FIG. 4 is a fragmentary perspective view of another embodiment of the cuff assembly of the present invention affixed to a surgical gown sleeve by adhesive means.
Figure 5:
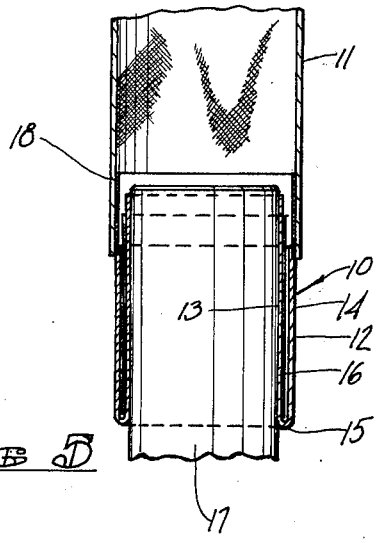
FIG. 5 is a fragmentary cross sectional elevational view of the cuff of FIG. 4 during attachment thereof to the sleeve the parts being located about a mandril.
Figure 6:
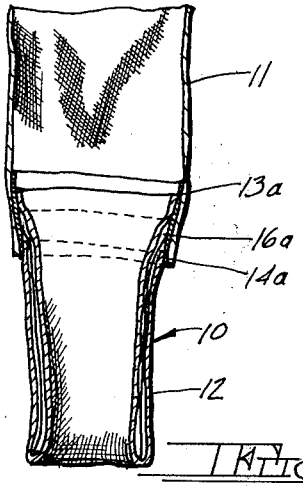
FIG. 6 is a fragmentary cross sectional elevational view of the cuff assembly and sleeve of FIG. 4.

FIGS. 4, 5 and 6 illustrate a second embodiment of the cuff assembly of the present invention, and again like parts have been given like index numerals. The cuff assembly is generally indicated in FIG. 4 at 10 and is shown adhered adhesively to a surgical gown sleeve 11. Again, for purposes of an exemplary showing, the sleeve 11 may be considered to be a part of a disposable gown made of a liquid strike-through resistant, cloth-substitute material.

Turning to FIG. 5, the cuff assembly 10 is made up of a cuff envelope 12 which may be identical to the cuff envelope 3 of the embodiment of FIGS. 1 through 3. That is, the cuff envelope 12 may be a stockinette made of knitted slow wicking cotton or any of the other materials listed above and folded upon itself so as to provide an inner wall 13, an outer wall 14 and a folded forward end 15. Located between inner wall 13 and outer wall 14 there is a layer of fluid impervious material 16 which may be identical to the fluid impervious layer or tube 8 of FIGS. 2 and 3 and may be made of any of the materials described with respect thereto.

For attachment of cuff assembly 10 to the open end of sleeve 11, the cuff assembly is illustrated as being mounted on cylindrical mandril 17 which is of such diameter that it will stretch the cuff assembly to a diameter substantially equal to the interior diameter of the open end of sleeve 11. It will be noted that the stockinette is so folded that the envelope outer wall 14 is shorter than the envelope inner wall 13. The tube of impervious material, again has (or is stretchable to) a diameter substantially equal to the internal diameter of the opening of sleeve 11. The lower end of the tube extends part way (or preferably nearly all the way) to the folded end 15 of cuff envelope 12. The upper end of the tube 16 is positioned slightly higher than the uppermost end of envelope outer wall 14 of the stockinette and slightly lower than the uppermost end of envelope inner wall 13 of the stockinette. Thus, the outer envelope wall 14, the liquid impervious layer 16 and the inner envelope wall 13 are arranged in overlappong or "shingled" orientation. Again the tube 16 may be additionally adhered to one or both cuff envelope walls at one or more places to prevent it from bunching or rolling upwardly within the envelope.

The cuff assembly 10 is attached to the sleeve 11. This is preferably accomplished adhesively in any appropriate manner. For example, the interior surface of the sleeve 11 at the open end thereof may be provided with a layer 18 of an appropriate adhesive such as a hot melt adhesive. The adhesive layer 18 should be of such width as to be capable of overlapping the upper end of the envelope outer wall 14 while extending slightly above the envelope inner wall 13 and contacting the liquid impervious layer 16. When heat is applied to the hot melt adhesive layer by any appropriate conventional means, it will be readily understood that the annular upper end portions of the envelope outer wall 14 and the liquid impervious layer 16, and an adjacent upper annular end portion of the envelope inner wall 13 (all of which abut the hot melt adhesive layer 18) will be individually adhered directly to the inner surface of sleeve 11 as at 14*a*, 16*a* and 13*a*, respectively, (see FIG. 6). Excellent results were achieved using an EVA adhesive sold by the E. I. DuPont De Nemours and Company, Inc. under the trademark Elvax and designation 260. The adhesive was formed into a film or tape 1 inch wide and from about 5 to about 10 mils thick and applied to the gown sleeve. A flexible, strong, non-bulky seam was achieved.

This method of joining the fluid impervious cuff assembly 10 to the surgical gown sleeve 11 has a number of advantages. First of all, it eliminates the necessity of a sewing step and the holes produced thereby. The attachment of the cuff assembly 10 to the sleeve 11 provides a good, fluid tight seal without a lot of bulk or stiffness. The cuff assembly 10 can be attached to the surgical gown sleeve 11 all at once. This eliminates the necessity for feeding multiple aligned layers through a sewing operation and renders the attachment step more readily mechanizable. While a hot melt adhesive has been shown and described as the adhesive means used, it will be evident to one skilled in the art that other types of appropriate adhesives can be used. It will be further understood that the adhesive may be applied to the cuff assembly 10 rather than to the sleeve 2, or to both. In addition, the shingling of the cuff assembly may be reversed and the cuff assembly may be attached to the outside surface of the sleeve 11.

Figure 7:
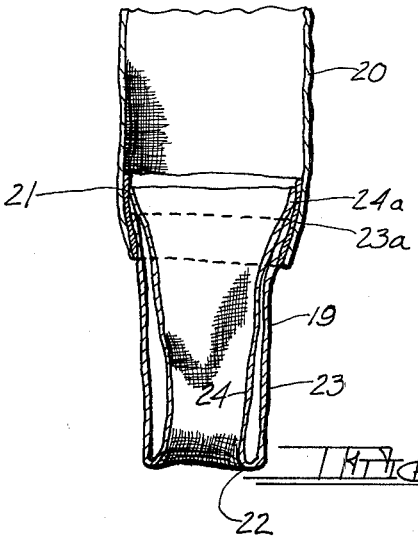
FIG. 7 is a fragmentary cross sectional elevational view, similar to FIG. 6, and illustrating a sleeve and a cuff structure without the fluid impervious layer.

The attachment procedure just outlined may be advantageously employed with cuffs not having a liquid impervious layer, not only for conventional reusable or disposable surgical gowns, but for other garments of the reusable or disposable type. This is illustrated in FIG. 7 wherein a stockinette cuff 19 is shown attached to a sleeve 20. The interior surface of the sleeve 20 near the opening thereof is again provided with an adhesive layer 21. The stockinette cuff 19 is formed into an envelope so as to have a folded forward end 22, an outer wall 23 and an inner wall 24. The inner wall 24 is slightly longer than the outer wall 23 so that the walls may be directly adhered to the inner surface of sleeve 20 as at 23*a* and 24*a*, respectively, in the same manner described with respect to FIGS. 5 and 6.

The joinder of stockinette cuff 19 to sleeve 20 has the same advantages described with respect to the embodiment of FIGS. 4 through 6. Again, a good bond is achieved between the stockinette walls and the surface of the sleeve without bulk or stiffness. The stockinette cuff 19 may be adhered to the sleeve 20 all at once rendering the operation more mechanizable.

Modifications may be made in the invention without departing from the spirit of it. For example, the cuff assembly need not be shingled in order to be attached to the sleeve by adhesive means. It is preferable to have a liquid-tight seal between the liquid impervious layer or tube and the gown sleeve. The cuff envelope walls and the liquid impervious tube or sheet could be adhered together prior to joinder to the sleeve.

It is within the scope of the invention to make the envelope inner wall and outer wall in the form of separate elements, sealing them at both ends with a liquid impervious tube located therebetween and sealed thereto at both ends of the walls.

In the embodiments of FIGS. 1 through 6 the envelope should be slow wicking either inherently or by virtue of appropriate treatment. The folded end of the envelope is the only direct connection between the inner and outer envelope walls. It is within the scope of the invention to further treat the folded end of the envelope to render it even more slow wicking or non-wicking to preclude a microbial transmission passage or vector around the liquid impervious tube via the folded end of the cuff envelope.

The term"slow-wicking" as used herein and in the claims is intended to refer to material for the cuff envelope which is of such nature that wicking around the folded end of the envelope will not occur during normal periods of use. Stockinettes knit of unbleached cotton are essentially non-wicking by virtue of the natural oils and waxes present in unbleached cotton.

The embodiments of the invention in which an exclusive property or privilege is claimed are defined as follows:

1. A liquid impervious cuff assembly for the sleeve opening of a protective garment, said cuff assembly comprising a cylinder of stretchable material folded back upon itself to form a double walled, substantially cylindrical cuff envelope folded at its forward end, open at its rearward end and having inner and outer walls, and a layer of liquid impervious material located between said inner and outer cuff envelope walls and extending from said rearward end of said envelope toward said folded end.

2. The cuff assembly of claim 1 wherein said stretchable material comprises a stockinette knit of slow wicking cotton.

3. The structure claimed in claim 1 wherein said layer of liquid impervious material comprises a thin flexible tube of material chosen from the class consisting of polymer or copolymer films of natural rubber, polyurethane, ethylene vinyl acetate, polyethylene, other synthetic latexes and combinations and copolymers of these.

4. The structure claimed in claim 1 wherein said layer of liquid impervious material comprises a thin flexible tube.

5. The structure claimed in claim 1 wherein at said rearward end of said cuff assembly, said inner wall, said fluid impervious layer and said outer wall are arranged in overlapping shingled orientation.

6. The structure claimed in claim 1 including a sleeve of a protective garment, having a free end with an opening therein, said open end of said cuff assembly being closed and affixed to said sleeve at said opening by stitches passing through said outer cuff envelope wall, said liquid impervious layer, said inner cuff envelope wall and said sleeve at said free end thereof.

7. The structure claimed in claim 1 wherein said protective garment is a surgical gown.

8. The structure claimed in claim 1 wherein said layer of liquid impervious material is substantially coextensive with said inner and outer envelope walls.

9. The structure claimed in claim 4 wherein said tube of liquid impervious material has a high modulus of elasticity and has a diameter substantially equal to the diameter of said sleeve opening, said stockinette being stretchable and normally having a diameter less than the diameter of said sleeve opening.

10. The structure claimed in claim 4 wherein said tube of liquid impervious material has a low modulus of elasticity and has a diameter less than the diameter of said sleeve opening, said stockinette normally having a diameter less than the diameter of said sleeve opening, said tube and said stockinette both being stretchable to a diameter at least equal to said diameter of said sleeve opening.

11. The structure claimed in claim 5 including a sleeve of a protective garment having a free end with an opening therein, said cuff assembly rearward end being affixed to said sleeve at said opening thereof by adhesively adhering each of said shingled portions of said cuff assembly inner wall, said liquid impervious layer and said cuff assembly outer wall directly to said sleeve near said sleeve opening.

12. The structure claimed in claim 6 wherein said protective garment is a surgical gown.

13. The structure claimed in claim 7 wherein said surgical gown is made of a liquid strike-through resistant cloth substitute.

14. The structure claimed in claim 11 wherein said cuff assembly inner wall, outer wall and liquid impervious layer are adhesively adhered directly to the inside surface of said sleeve near said sleeve opening.

15. The structure claimed in claim 11 wherein said protective garment is a surgical gown.

16. The structure claimed in claim 15 wherein said surgical gown is disposable and made of a liquid strike-through resistant cloth substitute, said adhesive comprising a hot melt adhesive.

17. A disposable surgical gown having a body-covering portion and sleeves, said body-covering portion and sleeves being made of a liquid strike-through resistant material, each of said sleeves terminating at its free end in a sleeve opening, a liquid impervious cuff assembly attached to each sleeve at said opening thereof, said cuff assembly comprising a cylinder of cloth-like material folded back upon itself to form a double-walled, substantially cylindrical cuff envelope folded at its forward end, open at its rearward end and having inner and outer cuff envelope walls, a layer of liquid impervious material located between said inner and outer cuff envelope walls and extending from said rearward end of said envelope toward said forward end, said inner and outer cuff envelope walls and said layer of liquid impervious material at said rearward end of said cuff envelope being attached to said surgical gown sleeve at said opening thereof.

18. The structure claimed in claim 17, wherein said cylinder of cloth-like material comprises a stockinette knit of slow wicking cotton.

19. The structure claimed in claim 17 wherein said layer of liquid impervious material comprises a thin flexible tube of material chosen from the class consisting of polymer or copolymer films of natural rubber, polyurethane, ethylene vinyl acetate, polyethylene, other synthetic latexes and combinations and copolymers of these.

20. The structure claimed in claim 17, wherein said layer of liquid impervious material comprises a thin flexible tube.

21. The structure claimed in claim 17, wherein said layer of liquid impervious material has a high modulus of elasticity and comprises a tube with a diameter substantially equal to the diameter of said sleeve opening, said envelope being stretchable and normally having a diameter less than the diameter of said sleeve opening.

22. The structure claimed in claim 17, wherein said layer of liquid impervious material has a low modulus of elasticity and comprises a tube with a diameter less than the diameter of said sleeve opening, said envelope normally having a diameter less than said diameter of said sleeve opening, said tube and said envelope both being stretchable to a diameter at least equal to said diameter of said sleeve opening.

23. The structure claimed in claim 17 wherein said cuff assembly is attached to said sleeve by adhesive means.

24. The structure claimed in claim 17, wherein said cuff assembly is attached to said sleeve by stitches passing through said outer cuff envelope wall, said liquid impervious layer, said inner cuff envelope wall and said sleeve.

25. The structure claimed in claim 17, wherein at said rearward end of said cuff assembly, said inner wall, said fluid impervious layer and said outer wall are arranged in overlapping shingled orientation so as to expose a narrow annular portion of said inner wall beyond said fluid impervious layer and a narrow annular portion of said fluid impervious layer beyond said outer wall, said narrow annular portions of said inner wall and said fluid impervious layer and an adjacent narrow annular portion of said outer wall being attached directly to said sleeve adjacent said sleeve opening by adhesive means.

26. The structure claimed in claim 25 wherein said cuff assembly inner wall, outer wall and liquid impervious layer are adhesively adhered directly to the inside surface of said sleeve near said sleeve opening.

27. A method of adhering a cuff assembly to the sleeve of a garment comprising the steps of providing a cylinder of stretchable cloth-like material, folding said cylinder upon itself to form a substantially cylindrical cuff envelope having an inner wall and an outer wall with said fold at the forward end of said cuff envelope, said sleeve having a free end with an opening therein, said cuff envelope normally having a diameter less than the diameter of said sleeve opening, arranging said fold such that one of said inner and outer walls is slightly longer than the other at the rearward end of said cuff envelope exposing a narrow annular portion of said longer wall beyond said other wall, stretching said cuff envelope to have a diameter substantially the same as said diameter of said sleeve opening, and adhesively adhering said annular portion of said longer wall and an adjacent annular portion of said other wall at said rearward end of said cuff envelope directly to said sleeve adjacent said sleeve opening.

28. The method claimed in claim 27 including the step of inserting a tube of liquid impervious material between said inner and outer cuff walls, said liquid impervious tube extending from within said cuff envelope to a point beyond said other wall and short of said longer wall to expose a narrow annular portion of said tube at said rearward end of said cuff envelope, and adhesively adhering said annular portion of said liquid impervious tube directly to said sleeve.

29. The method claimed in claim 27 including the step of applying a layer of adhesive to one of said sleeve adjacent said opening therein and said cuff assembly, said layer of adhesive having a width greater than the combined widths of said annular portions of said inner and outer cuff envelope walls, locating said open end of said sleeve adjacent said annular portions of said inner and outer cuff envelope walls and adhering said sleeve and said cuff assembly together.

30. The method claimed in claim 27 wherein said fold is arranged such that said inner wall is longer than said outer wall, said cuff assembly inner and outer wall annular portions being adhered directly to the inside surface of said sleeve adjacent said sleeve opening.

31. The method claimed in claim 28 wherein said fold is arranged such that said inner wall is longer than said outer wall, said inner and outer wall annular portions and said annular portion of said liquid impervious tube being adhered directly to the inside surface of said sleeve adjacent said sleeve opening.

32. The method claimed in claim 28 wherein said cylinder of stretchable cloth-like material comprises a stockinette knit of a slow wicking cotton.

33. The method claimed in claim 28 including the step of applying a layer of adhesive to one of said sleeve adjacent said opening therein and said cuff assembly, said adhesive layer having a width greater than the combined widths of said annular portions of said inner and outer cuff envelope walls and said liquid impervious tube, locating said open end of said sleeve adjacent said annular portions of said inner and outer cuff envelope walls and said liquid impervious tube and adhering said sleeve and said cuff assembly together.

34. The method claimed in claim 29 wherein said adhesive is a hot melt adhesive.

35. The method claimed in claim 33 wherein said adhesive is a hot melt adhesive.

* * * * *